United States Patent [19]

Quehen

[11] 4,127,997

[45] Dec. 5, 1978

[54] ROLLING MILL STAND

[75] Inventor: André Quehen, Pontoise, France

[73] Assignee: SECIM, Courbevoie, France

[21] Appl. No.: 859,508

[22] Filed: Dec. 12, 1977

[30] Foreign Application Priority Data

Dec. 17, 1976 [FR] France ..... 76 38143

[51] Int. Cl.[2] ..... B21B 37/08; B21B 1/10

[52] U.S. Cl. ..... 72/19; 72/21; 72/225; 72/238

[58] Field of Search ..... 72/238, 239, 225, 6, 72/21, 19

[56] References Cited

U.S. PATENT DOCUMENTS 3,585,831 6/1971 Lemper ..... 72/239

3,665,746 5/1972 Eibe ..... 72/239

FOREIGN PATENT DOCUMENTS 52-16061 6/1977 Japan ..... 72/6

*Primary Examiner*—Milton S. Mehr

*Attorney, Agent, or Firm*—Daniel Patch; Suzanne Kikel

[57] ABSTRACT

A universal cassette type stand for a continuous rolling line which can be converted from a universal beam stand having two horizontal rolls and two vertical rolls into a stand having two horizontal rolls for rolling structural shapes. Each horizontal and vertical roll includes two hydraulic tightening jacks each associated with a different chock. Each jack is provided with a servo-valve, a position sensor, and a pressure probe. The supply of each jack is servo-controlled by a regulation loop where the measurement of the tightening is transformed into a position reference depending on the modulus of either the lower or upper part or sides of the stand. The regulation or control loop is such that one of several alternatives for rolling the beam to a desired mode can be accomplished. For instance, the loop can be set up to obtain (1) a constant web, constant flange thickness while maintaining symmetry of the web relative to the flange, or (2) the loop can be set up to obtain a ratio thickness of web relative to the flanges while still maintaining symmetry of the web relative to the flange.

6 Claims, 7 Drawing Figures

ROLLING MILL STAND

The invention relates to a stand of the cassette type used in a continuous rolling mill which can be converted from a universal beam stand having both horizontal and vertical rolls into a stand having horizontal rolls for rolling structural shapes other than beams.

In a universal stand, the beam is rolled between two horizontal rolls to develop the web, and between two vertical rolls to develop the flanges.

The stands presently used in continuous structural shape rolling lines may be classified according to two types.

The first type is a complete stand which is prepared in the shop and installed on the rolling line after removing the previous rolling stands. This design is costly and requires strict roll adjustments in the shop. Furthermore, with this type of stand, the adjustment of the gap between rolls requires not only a precise knowledge of the product rolling load, but also of the precise modulus of the stand. Since the stand is not pretensioned in the shop, preliminary adjustments made in the shop only compensate for the mechanical clearances and therefore it is generally necessary to make additional adjustments on line, between the rolling of bars, if the output product does not fall within the desired tolerances.

The second type is a cassette type stand. Here the housings of the stand are fixed on the rolling line, and the horizontal rolls and vertical rolls are supported by a removable cassette which can be introduced between the housings after adjustments have been made in the shop.

Both types of structural shape stands have upper and lower mechanical screw down or tightening devices which are sufficient if large tolerances on the thickness of the beam webs are all that is required. However, the increased demand for lighter beams with very thin webs has resulted in the requirement that stricter tolerances be used in rolling, and this, in turn requires instantaneous readjustments be made to the rolls during rolling to compensate for the variation in the beam due to temperature and hardness.

Furthermore, the conventional mechanical screw-down devices do not maintain a constant pass line of the web between the two horizontal rolls, while the vertical rolls that shape the flanges remain fixed. There results from this a risk of dissymmetry of the position of the web relative to the flanges, which is highly undersirable for lightweight beams.

Finally, in some cases, it may be important, while accepting a slight variation of the thickness, to try to maintain a constant ratio between the thickness of the web and that of the beam flanges. This is impossible to obtain with the conventional adjustment devices.

This invention enables compliance with the above requirements for the rolling of lightweight beams by providing a universal stand for a continuous beam rolling line with two horizontal rolls and two vertical rolls centered on the pass line of the products. The stand is of the cassette type with fixed roll housings in the rolling line and at least one movable cassette supporting the horizontal rolls and vertical roll chocks.

According to the invention, the stand includes, for each horizontal roll two hydraulic tightening jacks each associated with a chock, and each located between the chock and the roll housing, and integral with the fixed part of the stand, each jack being provided with a supply servo-valve for supply from a fixed hydraulic power unit with a linear position sensor for the piston, and with a pressure probe. In order to hold constant the thickness of the web, and to hold the position of this web symmetrical relative to the flanges, for each horizontal roll, the supply of the hydraulic jacks is servo-controlled by a regulation loop in which the measurement of the tightening effort recorded by the pressure probes is transformed into a position reference taking into account the modulus of only the upper or lower portion of the stand corresponding to the horizontal roll, the position reference being then compared to the actual position recorded by each linear position sensor to generate an error signal acting one each servo-valve.

In another form of the invention, intended to enable holding also constant the thickness of the flanges and their symmetry relative to the web, the stand further includes, for each vertical roll, an hydraulic tightening jack associated with the vertical roll chock, and located between the chock and the cassette frame, integral with the cassette; each jack is provided with a servo-valve supplied by an hydraulic power unit, a linear position indicator for the piston, and a pressure probe. The supply of each vertical roll tightening jack is then servo-controlled by a regulation loop in which the measurement of the tightening effort recorded by the pressure probes is transformed into a position reference taking into account the modulus of the side of the cassette corresponding to one of the vertical rolls, the position reference being then compared to the actual position recorded by each linear position sensor, to produce an error signal acting on each servo-valve.

In another form of the invention, especially intended to maintain a constant ratio between the thickness of the flanges and that of the web, the stand includes a pressure probe associated with each vertical roll chock which measures the tightening effort of the vertical rolls, which measurement is transformed into a displacement reference taking into account the total modulus of the cassette. This reference is then introduced in each loop regulating the supply of the hydraulic jack of the horizontal roll through a selective switching device, thus eliminating the signal arriving from the pressure probes of the jacks for the horizontal rolls and at the same time the individual regulation of the jacks for the vertical rolls.

Since the universal stand may easily be changed into a two roll stand for the rolling of the usual structural shapes, through the simple substitution of the cassette with a cassette without vertical rolls, the invention also applies to such a two-roll stand.

In now describing the invention in more detail, referring to special methods of application given as examples, and represented in the attached drawings of which:

Figure 4:
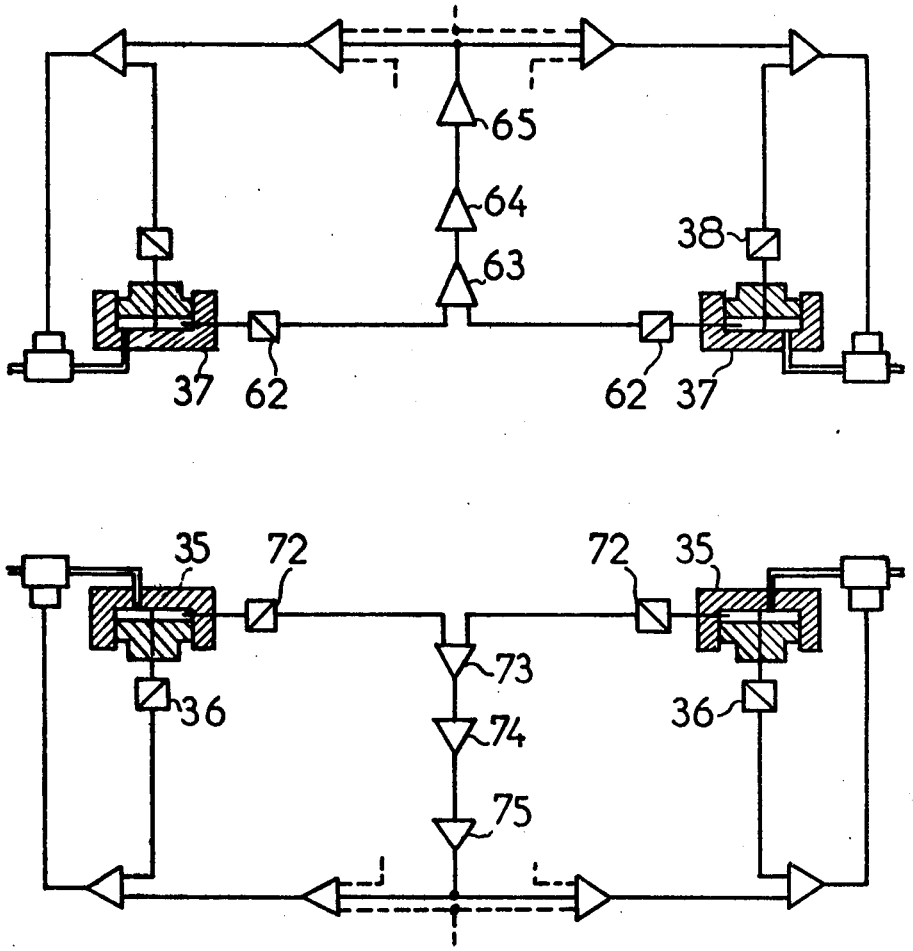
Figure 5:
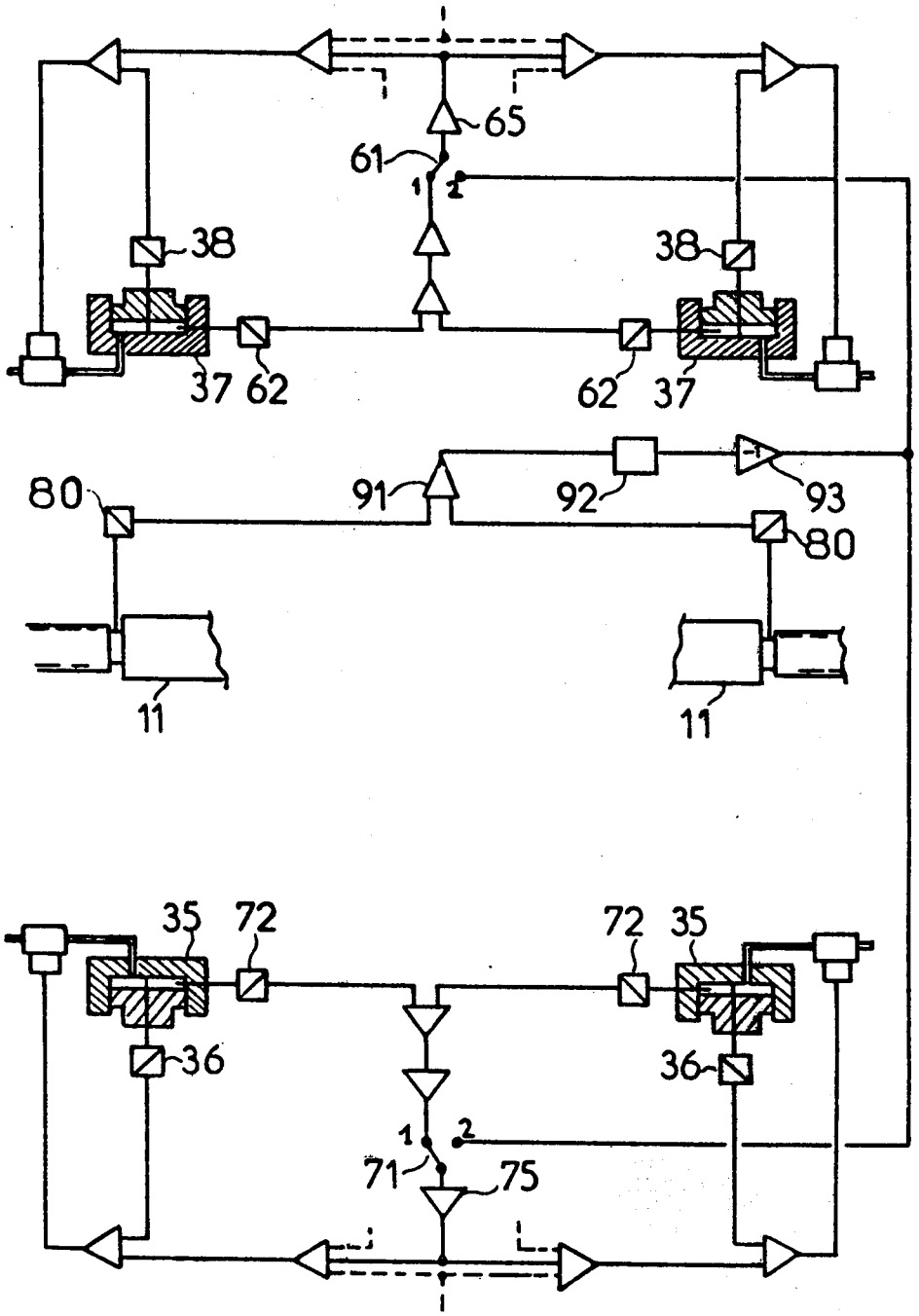
Figure 6:
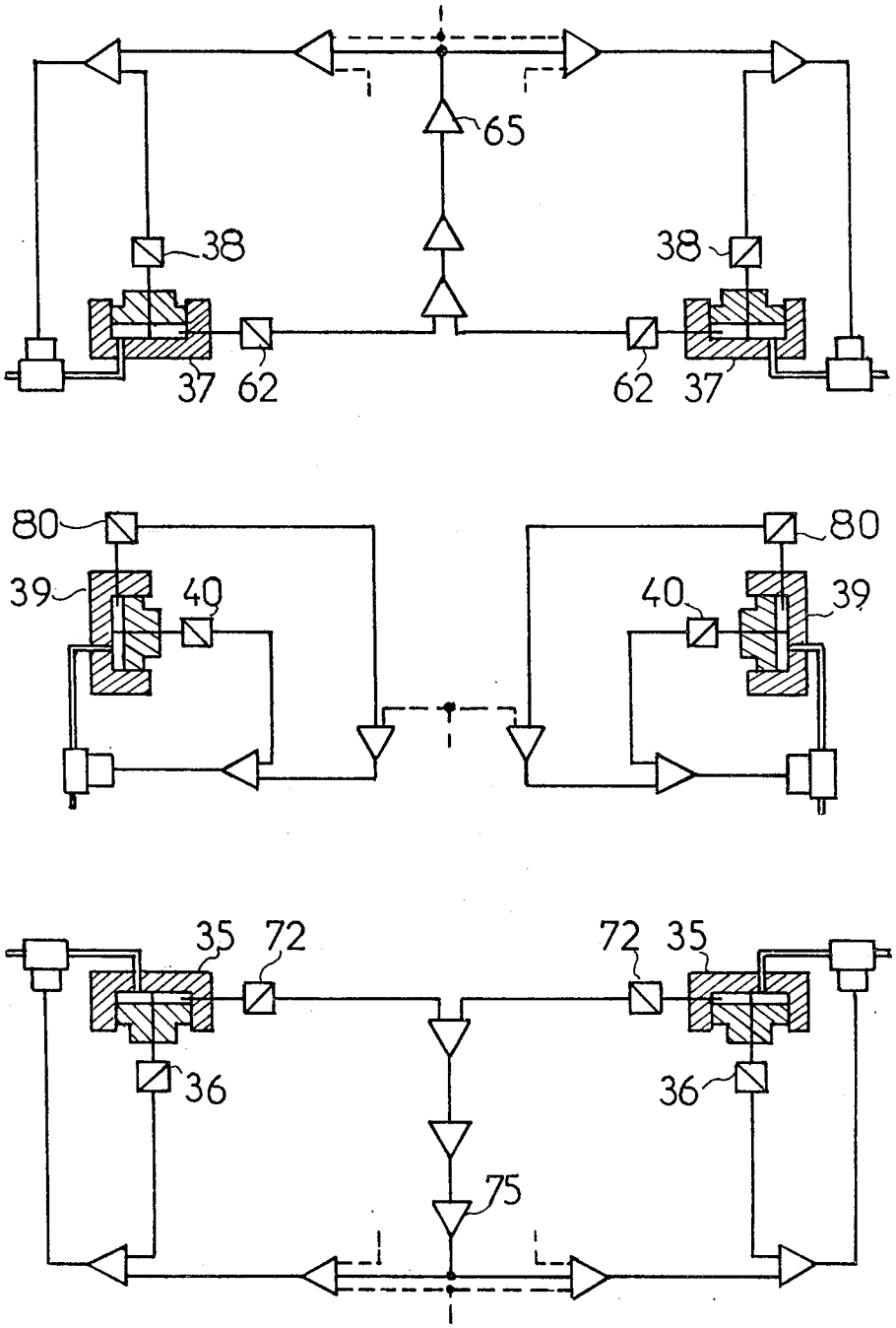
Figure 7:
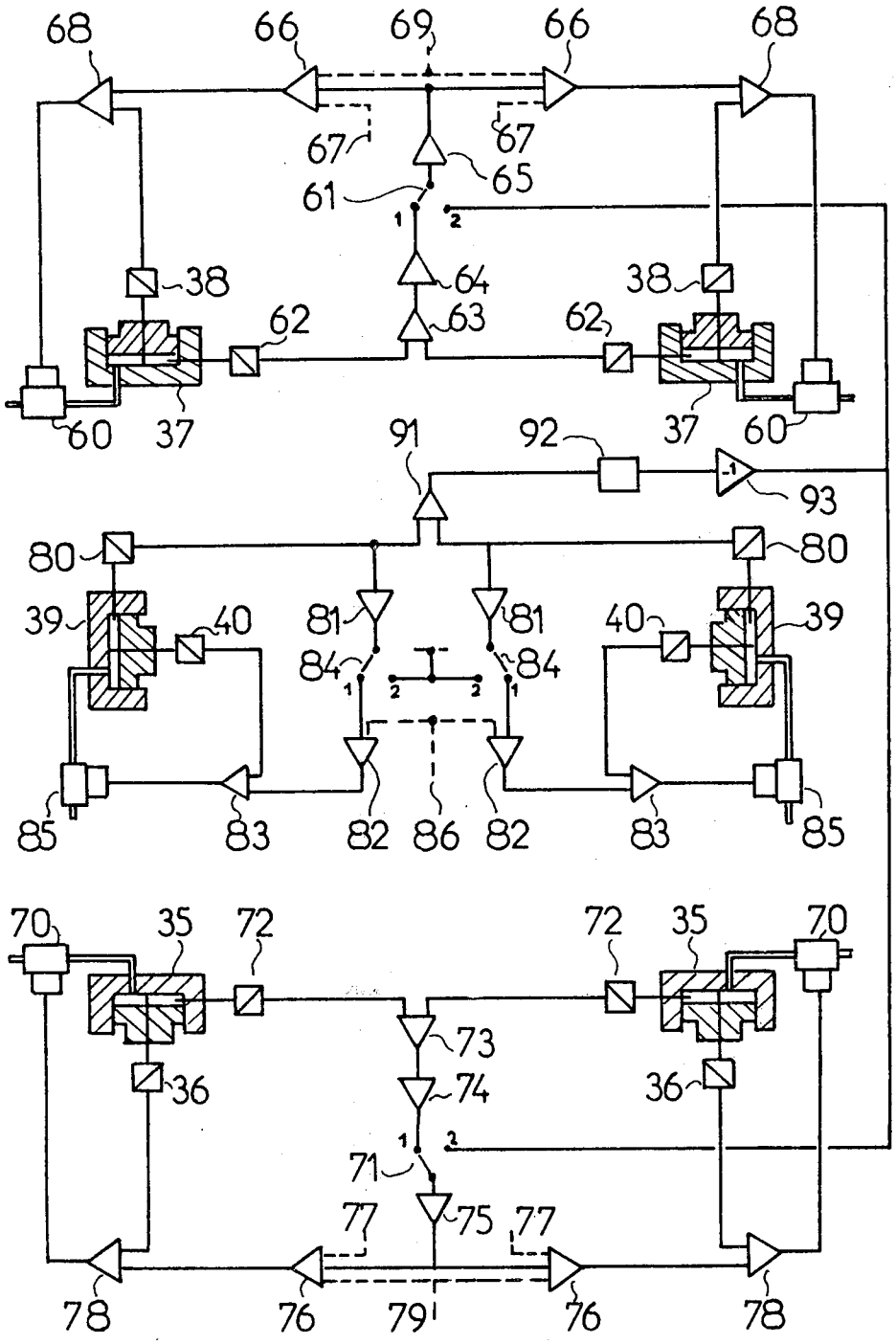

FIGS. 4 through 7 represent various alternatives for the regulating system for the hydraulic supply of the jacks. FIG. 4 covers the case of the maintenance of a constant web thickness, and of the symmetrical position relative to the flanges. It also applies to the case of a two-roll stand for structural shapes;

FIG. 5 represents the supplementary devices for maintaining a constant ratio between the thickness of the web and that of the flanges of a beam;

FIG. 6 illustrates a schematic for a stand to insure the regularity of the web thickness and also that of the flange thickness of a beam; and Finally, FIG. 7 shows a schematic for selecting either the constancy of the thickness of the web and flanges while maintaining symmetry or maintaining a constant ratio between the thickness of the web and that of the flanges.

Figure 1:
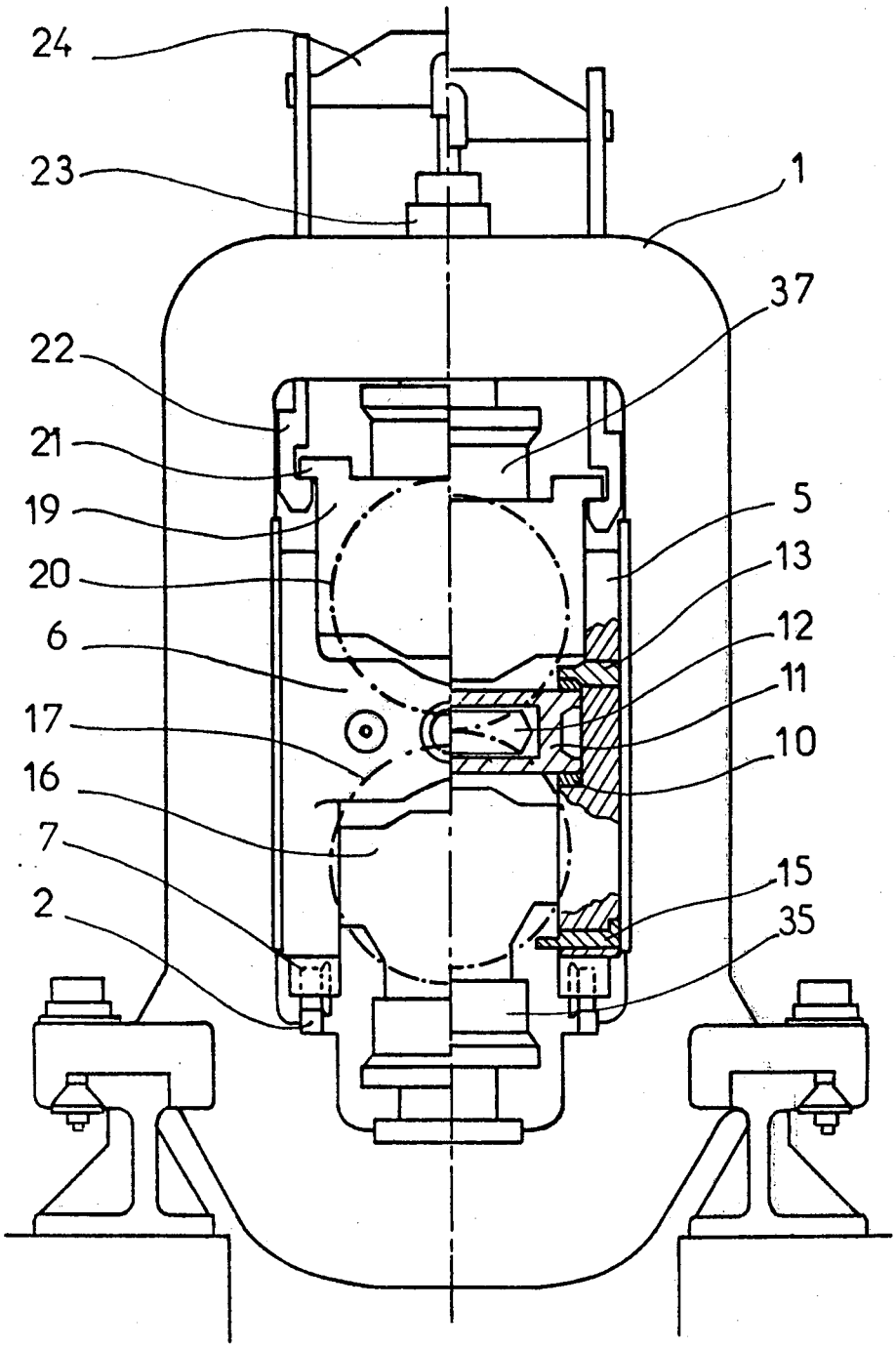
FIG. 1 is an elevational side view, partly in section, of a cassette stand illustrating the present invention used as a universal stand. To the left of FIG. 1 the outline form of the horizontal rolls represent the removal position for the rolls: the right side represents a working position.
Figure 2:
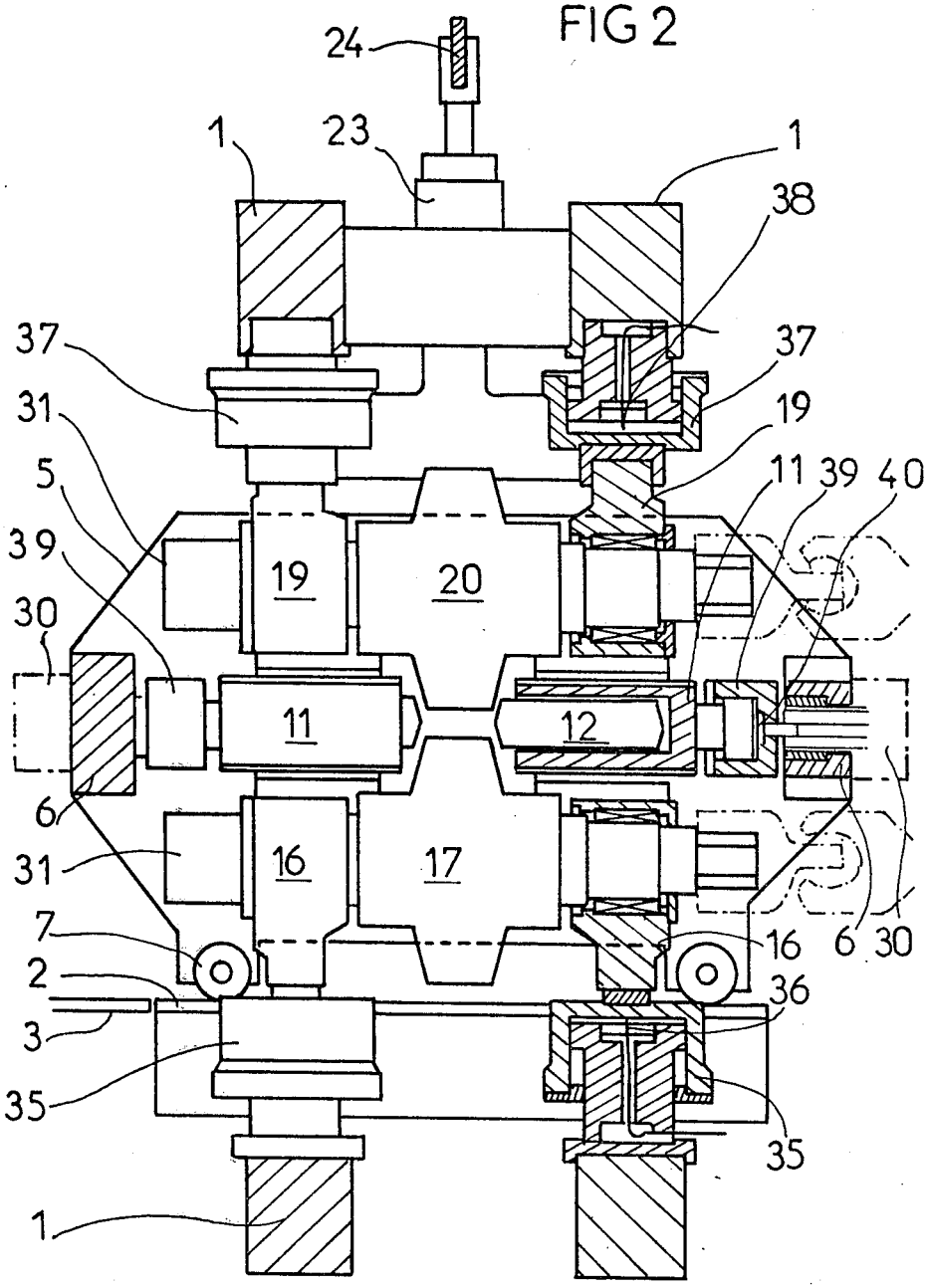
FIG. 2 is a front view partly in section of the stand shown in FIG. 1. To the right of the figure, the section passes through the centerline of the horizontal rolls and chocks; to the left, the horizontal roll and vertical roll chocks are represented as seen from outside together with the upper and lower tightening devices.

Referring first to FIGS. 1 and 2, the stand has two housings 1 fixed in position in the rolling mill line. It also includes rails 2 running transversely inside the stand, and extending outside, indicated at 3. These rails are used as guides and supports for the removable cassette consisting of two transversal brackets 5 connected at each end by spacers 6. The cassette rests on rails 2 by rollers 7.

Best shown in FIG. 1, the brackets 5 having liners 10 receive chocks 11 of vertical rollers 12. Both chocks 11 are locked into position by wedges 13 which are represented here in a simplified manner, but which also include adjusting shims and sliding plates.

Beneath chock 11 of FIG. 1, bracket 5 of the cassette has clamps 15 on which the chocks 16 of the lower horizontal roll 17 may engage when roll 17 is lowered. Chock 19 of the upper horizontal roll 20 includes lugs 21 which are engaged by hooks 22 connected to crossbar 24 and raised and lowered by roll balancing cylinder 23.

Each lower chock 16 rests on an hydraulic tightening jack 35 conventionally supplied from an hydraulic power unit. This power unit, the jack supply piping, and the servo-valve are not shown in FIGS. 1 and 2, but are of the conventional type. Each hydraulic jack 35 is provided with a linear position meter 36 located on the centerline of the jack which detects the exact vertical positioning of the lower horizontal roll 17. Each jack 35 is also provided with a pressure sensor for detecting the pressure in the jack, and consequently, the rolling load. Here again, the pressure sensor is not shown in these particular FIGS. 1 and 2. It may be of any known type, and is located either in the jack or in the supply piping.

Similarly, at the top of the stand, hydraulic tightening jacks 37 are located between the housings 1 of the stand and the upper chocks 19. Each jack 37 is also provided with a linear position meter 38 and a pressure sensor which is not shown in FIGS. 1 and 2.

The initial gap setting of the vertical rolls 12 is obtained by the conventional mechanical screw down mechanism 30 shown only in FIG. 2, which mechanism acts to transversely displace the vertical roll chock 11. Between the chocks 11 and the screw down mechanism is an hydraulic tightening jack 39 connected by a servo-valve to an hydraulic power unit not shown in FIGS. 1 and 2. As in the case of the tightening jacks 35 and 37 for the horizontal rolls, the tightening jacks 39 of the vertical rolls are each provided with a linear position meter 40 and a pressure sensor which is not shown in FIGS. 1 and 2. All the pressure probes 62, 72 and 80 are best shown in the schematic drawings.

FIG. 2 also represents in dash-dot lines the spindle drives for the horizontal rolls. These spindles are of a conventional type in structural shape rolling mills, and are well known to those in the art.

Finally let it be noted that the lower and upper tightening jacks 35 and 37 acting on the horizontal roll chocks are integral elements of the housings of the stand, while the jacks 39 acting on the vertical roll chocks are an integral part of the removable cassette of the rolling mill. It results from this that the horizontal roll tightening jacks 35 and 37 may be supplied from a fixed hydraulic power unit, while the vertical roll jacks may be supplied from either a small hydraulic power unit in the cassette itself or from a main stationary hydraulic power unit with movable connections connected to the jacks when the cassette is installed in its position in the rolling line.

The procedure for preparing a replacement cassette in the shop prior to its installation in the rolling line will now be given.

A set-up stand including the upper roll balancing system 23-24, a lower and upper tightening mechanism, or hydraulic jacks 35-37 together with an hydraulic power unit for supplying fluid to the tightening jacks of the vertical rolls in the instance where the cassette does not have a self-sufficient hydraulic power unit to be inserted into the rolling line, are provided.

The cassette is provided with two horizontal rolls 17, 20 and two vertical rolls 12 with their respective chocks. The lower chocks 16 rest on clamps 15; the vertical roll chocks 11 rest on the liners 10 and are locked in position by wedges 13. The upper chocks 19 rest on wedges 13. After checking the positioning of the centerline of the lower horizontal roll relative to the edge of the cassette, this cassette is then introduced into the set-up stand.

The adjustment of the vertical rolls in the centerline of the stand is then made. The vertical rolls through the screws 30 or jacks 39 installed on the cassette are loosened to bring them to a theoretical width of the beam to be rolled. A template corresponding to the product to be processed by the stand is introduced between the vertical rolls and by use of the tightening jacks 39 the rolls are adjusted or tightened until the rolling pressure is reached. The position of the position sensors in the jacks is then marked; this position is called the reference position.

The vertical rolls are loosened, and the lower and upper horizontal rolls, through their respective tightening mechanisms 35-37 are brought to the pass line. At this time, the horizontal rolls are separated to introduce the template. Using the jacks 35-37 the horizontal rolls are brought into contact with the template and are tightened until the rolling pressure is reached. Once this symmetry is adjusted and the position of the theoretical zero is marked, the jacks are released.

The cassette is then installed and locked into position in a stand set up in the rolling line by clamps 15 at the base of the stand. Using the tightening jacks 39, the position of the vertical rolls is adjusted to the zero previously marked. The upper horizontal roll balance is then set into position. Using the tightening jacks 35–37, the horizontal rolls are brought into contact with the pass line marked in the shop, and they are slowly rotated in order not to risk marking them. The jack pressure is increased to the rolling pressure to take up the clearances between the mill elements and the stand has released. The zero reference of the electronic regulation system is now established. The upper and lower horizontal rolls are loosened by a value equal to the thickness of the web of the beam to be rolled and the stand is ready for operation.

Reference will now be made to FIG. 7 for a description of the regulation systems for the supply of the various hydraulic jacks tightening the horizontal rolls or the vertical rolls.

Each upper jack 37 is supplied from an hydraulic power unit, which is not shown, through a servo-valve 60. The output signal of each one of the two pressure probes 62 is brought into an operation amplifier or op amp 63 operating as a summation, or more precisely as a half-summation, so that the output signal is representative of the half-sum of the pressures in the jacks 37, i.e. representative of the rolling force developed by the upper horizontal roll 20. The op amp 64 contains the modulus reference (total stiffness of the stand) so that the signal arriving from 63 and representing the rolling force is transformed in op amp 64 into a signal representative of the elongation of the stand under this rolling force. This elongation value is corrected in the amplifier 65 by the ratio of the stiffness of the part of the stand located above the pass line to the total stiffness of the stand. The output signal of 65 thus represents the displacement of the upper horizontal roll above the theoretical pass line due to the rolling force, and consequently the value by which the horizontal roll shall have to be tightened further. This reference value is applied through the summator 66 on each one of the comparators 68 which also receive a signal from the linear position meter 38 representing the actual displacement of the jack 37. The output signal of the comparator 68 instantaneously orders the direction and the intensity of the movement of the servo-valve 60 which returns jack 37 to the desired position.

The above description also applies to the regulating systems for the lower jacks 35 which are represented in the lower part of FIG. 7. Of course, the correction generated by the amplifier 75 applies here for the stiffness of the lower part of the stand located below the theoretical pass line. From this, it is easy to see that what is obtained is a regulation of the beam web thickness through constant monitoring of the rolling force by the pressure probes and the instantaneous correction of the variations of the yielding of the stand when the rolling force varies due to changes in the rolling conditions such as variations of temperature or of thickness of the rough workpiece. Furthermore, due to the specific correction generated by devices 65 and 75, which take into account the different stiffness values for the upper and the lower part of the stand, the horizontal roll position corrections are generated in order to always maintain the average plane of the web in the theoretical pass line, i.e. in order to always maintain the position of the web symmetrically relative to the flanges.

It is furthermore noted that the summators 66 or 76 make it possible to take into account in the regulation loop possible manual corrections, either in a balanced manner for each side of the stand through the introduction of the correction signal in 69 or 79, or even in an unbalanced manner in order to produce a slight tilting of one or the other of the hydraulic jacks or cylinders by acting separately on each side on 67 or 77.

In the center of FIG. 7 is a schematic of a regulation loop controlling the tightening jacks 39 associated with the vertical rolls. As can be seen, the switches 84 are in position No. 1. In this case, both loops for the vertical rolls are independent. The signal from the pressure probe 80 is transformed in the operational amplifier 81, and taking into account the stiffness characteristic of the side of the cassette relative to the vertical rolls under consideration, into a signal representative of the displacement of the vertical roll due to the tightening force. This signal is applied through summator 82, to comparator 83 which also receives the signal from the linear position meter 40. Here again, the output signal from the comparator 83 instantaneously orders the direction and the intensity of the movement of the servo-valve 85 supplying the jack 39.

Similar to the horizontal roll tightening jacks, it is also possible to introduce to the vertical roll tightening jacks manual corrections through a signal entered in 86.

If switches 61, 71 and 84 of the entire loop system in FIG. 7 are in position No. 1 there is provided a regulation of the thickness and a maintenance of the symmetry for the flanges as well as for the web of the beam. The same loop system with the switches in position No. 2, provides for the proportionality of the thickness variations in the web and in the flanges of the beam. In this case, the output signals from the pressure probes 80, which represent the value of the tightening force on the vertical rolls, are applied to amplifier 91 operating as a half-summator and this makes it possible to have available a signal representing the total tightening force. This signal is applied on system 92, in which there may be introduced the reference of the desired web/flange thickness ratio. After passing through amplifier 93, which only operates here as a sign inverser for adaptation to the downstream system, the signal is distributed to the two regulation loops for the jacks associated with the upper and lower horizontal roll. Each amplifier 65 and 75 respectively takes into account the stiffness of its upper or lower part of the stand, It can thus be seen that any variation of the tightening force on the flanges, and consequently any variation in the thickness of the flanges, results in an immediate corresponding correction of the thickness of the web, always taking into account the respective values of the yielding of the upper and lower part of the stand, so that the position of the web is maintained symmetrically relative to the flanges.

Of course, the complete schematic on FIG. 7 is simplified if only part of the regulating or controlling possibilities is desired. If it is not necessary to insure under certain rolling conditions a large strictness in the thickness of the flanges, a mechanical tightening on the vertical roll chocks 11 can be obtained. The schematic of FIG. 5 represents this situation and it will be shown that it still provides a constant ratio between the web and flange thicknesses. Here the pressure probes 80 include a so-called sensing part located between the chock and the tightening screw in order to produce a signal which, as in FIG. 7, represents the tightening force on the flanges and directs an order for immediate correction for the web thickness.

If only a regulation of the thickness of web and flanges and the maintenance of the web semmetry, without a constant ratio between the web and flange thicknesses are desired, the schematic may be simplified as in FIG. 6, wherein the regulation loops are independent.

Finally the schematic is even more simplified in FIG. 4 and still makes it possible, through the instantaneous regulation of the position of the jacks 35 and 37, and through the taking into account separately the stiffness of the upper and the lower part of the stand, to produce beams with a very fine web precision, which web is always maintained symmetrically relative to the flanges. In FIGS. 5, 6 and 4, unless otherwise noted, the elements of this system as indicated by common reference characters function as explained in connection with FIG. 7.

Figure 3:
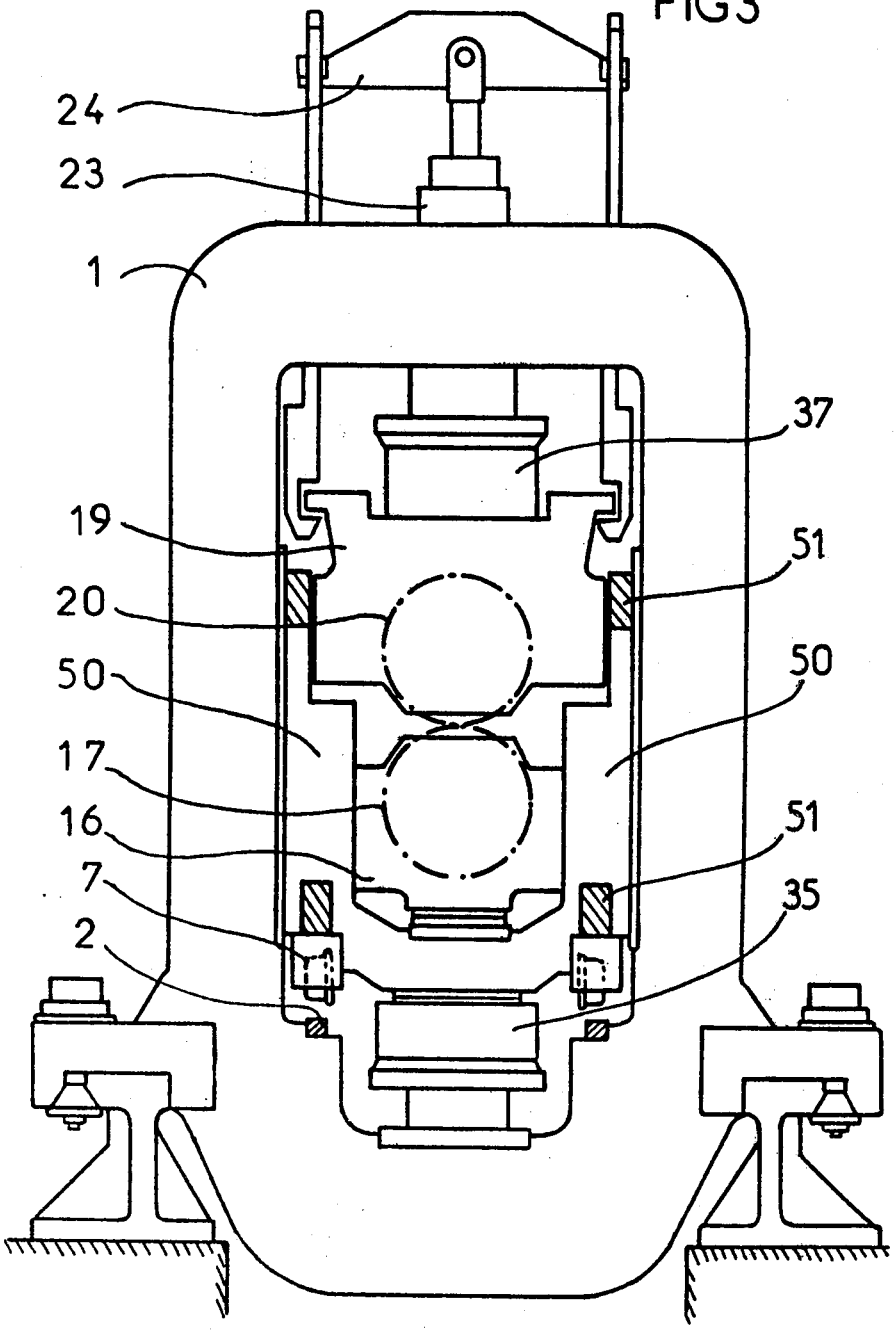
FIG. 3 is an elevational side view illustrating the present invention when a two roll stand is used for structural shapes. The horizontal rolls are represented in their working position.

The stand which has been described in FIGS. 1 and 2 may easily be changed into a two-roll stand for the rolling of standard structural shapes. Referring to FIG. 3 which describes this alternative, there is found again the same fixed stand elements, i.e. the upper and lower tightening jacks 35 and 37, equipped as in the stand in FIGS. 1 and 2 with supply servo-valves, pressure probes, and linear position meters. But here, cassette 50 is presented in the shape of a "U" in which the chocks 16 and 19 of the horizontal rolls 17 and 20 may move. The two end pieces of the cassette are connected by transversal spacers 51. The horizontal rolls with their chocks are pre-adjusted in the shop before the cassette is introduced into the stand.

During the rolling operation, the upper chocks, as in the case of the universal stand, are locked against the upper tightening jacks 37 by the hydraulic balancing device 23–24. The lower part of the cassette directly rests on the hydraulic tightening jacks 35 and the lower chocks 16 rests on the horizontal part of the cassette end pieces, thus, directly receiving the tightening forces from the jacks 35. The regulation schematics for this two-roll stand may then be that of FIG. 4, and in addition to other features noted above, will maintain the average pass line of the rolled product at a fixed elevation relative to the mill floor line.

Of course, the invention is not strictly limited to the methods of application which have just been described as examples, but it also covers applications which would differ from it only because of details, alternatives of application, or through the use of equivalent means. Thus, one could also use the vertical roll tightening jacks 39 not only to provide the tightening force, but also to move the chocks depending on the dimensions of the beam to be processed. The device represented in FIG. 2 constitutes, however, a more interesting set-up in that the general positioning is provided by the screw down mechanism 30 and that the jack only provides finite displacements. This among other things requires only a small volume of oil for the hydraulic system, and consequently uses a generating set of small dimensions which are easy to install permanently on the cassette itself.

Similarly, the regulation schematics have been described in analogic regulation, but it is well understood that they could easily be transferred by any specialist in that field into a functionally equivalent regulation using digital computers.

In accordance with the provisions of the patent statutes, I have explained the principle and operation of my invention and have illustrated and described what I consider to represent the best embodiment thereof.

I claim:

1. A stand of a continuous rolling mill for producing beams and similar sections including two horizontal and two vertical rolls, the stand being centered on the pass line of the beam to be rolled and having fixed roll housings in the rolling line for receiving a removable cassette for supporting said rolls and their chocks for each said rolls, the improvement comprising:

hydraulic tightening jack means for a different chock of each horizontal roll, a said jack means located between a chock and associated housing and being supportable by an associated housing, servo-valve means for said jack means for supplying hydraulic fluid to said jack means from an hydraulic power means, linear position sensor means for each horizontal roll for producing a signal representative of the actual position during rolling of at least one associated jack means, pressure sensor means for producing a signal representative of the working pressure of at least one of said jack means for each horizontal roll, and control means including means for producing signals representing the modulus for each portion of the stand associated with a different horizontal roll, means for receiving said pressure sensor signals and combining them with the modulus signal for the same stand portion to produce position reference signals for each horizontal roll, means for receiving said linear position signals, and means for comparing said corresponding position reference signals with said corresponding signals representing the actual positions of corresponding jack means for said horizontal rolls to generate command signals for operating said servo-valve means for said jack means for each roll for maintaining a constant web thickness and a symmetrical web position relative to a flange portion of the beam.

2. A stand according to claim 1 wherein for said two vertical rolls the improvement further comprises:

pressure sensor means associated with at least one of said vertical rolls for producing a signal representative of the working pressure of at least one of said vertical rolls, and wherein said control means further includes means for producing a signal representing at least that portion of the modulus of the cassette associated with said one vertical roll, means for receiving said pressure sensor signal and combining it with said modulus signal to produce a position reference signal for at least said one vertical roll, means for receiving said position reference signal and for applying it with a desired web/flange thickness ratio signal to produce an alternate command signal for operating said servo-valve means, means for alternatively causing a first operation of said servo-valve means to maintain a constant web thickness and symmetrical web position relative to a flange portion of the beam or a second operation of said servo-valve means to maintain constant thickness ratio between the web and the flange and a symmetrical web position relative to a flange portion of the beam and for selecting the appropriate position reference signal, said control including means effective only during said second operation of said servo-valve means for rendering inoperative said position reference signal for each horizontal roll.

3. A stand according to claim 1 wherein for said two vertical rolls the improvement further comprises:

an hydraulic tightening jack means for each vertical roll, each said jack means located between an associated chock and said cassette and being supportable by said cassette, servo-valve means for said jack means for said vertical rolls for supplying hydraulic fluid to these jack means from said hydraulic power means, linear position sensor means for each vertical roll for producing a signal representative of the actual position during rolling of an associated jack means, pressure sensor means for producing a signal representative of the working pressure of at least one of said jack means for each vertical roll, and wherein said control means further includes means for producing signals representing the modulus for each portion of the cassette associated with a different vertical roll, means for receiving said pressure sensor signals for said vertical rolls and combining them with the modulus signal for the same cassette portion to produce position reference signals for each vertical roll, and means for receiving said linear position signals for said vertical rolls and means for comparing said corresponding position reference signals with said corresponding signals representing the actual positions of corresponding jack means for said vertical rolls to generate command signals for operating said servo-valve means for said jack means for each vertical roll for maintaining a constant flange thickness.

4. A stand according to claim 3 further comprising:

screwdown means located between each said jack means of said vertical rolls and a portion of said cassette associated with each said vertical roll, and wherein said hydraulic power means includes separate power means for each vertical roll carried by said cassette.

5. A stand according to claim 3 wherein said control means further includes:

means for receiving said position reference signals for said vertical rolls and for applying said signal with a desired web/flange thickness ratio signal to produce an alternate command signal for operating said servo-valve means for said horizontal rolls, means for alternatively causing a first operation of said servo-valve of each horizontal and vertical roll means to maintain a constant web and a constant flange thickness and a symmetrical web position relative to a flange portion of the beam or a second operation of said servo-valve means of only said horizontal rolls to maintain constant thickness ratio between the web and the flange and a symmetrical web position relative to a flange portion of the beam and for selecting the appropriate position reference signal, said control including means effective only during said second operation of said servo-valve means for rendering inoperative said position reference signal for each horizontal roll.

6. A stand for a continuous structural shape rolling line having two horizontal rolls centered on the pass line for the product, and being of the cassette type with fixed roll housings in the rolling line, and at least one removable cassette supporting the horizontal rolls and their chocks, the improvements comprising:

hydraulic tightening jack means associated with a different chock of each horizontal roll, said jack means located between the chocks of an associated housing and being supportable by an associated housing, servo-valve means for said jack means for supplying hydraulic fluid to said jack means from an hydraulic power means, a linear position sensor means for each roll for producing signals representative of the actual linear displacements of an associated horizontal roll, pressure sensor means for producing a position reference signal representative of the working pressure of at least one of said jack means for each roll, and control means including means for producing signals representing the modulus for each portion of the stand associated with a different horizontal roll, means for receiving said pressure sensor signals and combining them with the modulus signal for the same stand portion to produce position reference signals for each horizontal roll, means for receiving said linear position signals, and means for comparing said corresponding position reference signals with said corresponding signal representing the actual position of corresponding jacks for said horizontal rolls to generate command signals for operating said servo-valve means for said jack means for each roll for maintaining a desired operational condition.

* * * * *

UNITED STATES PATENT AND TRADEMARK OFFICE

CERTIFICATE OF CORRECTION

PATENT NO. : 4,127,997

DATED : December 5, 1978

INVENTOR(S) : André Quehen

It is certified that error appears in the above-identified patent and that said Letters Patent are hereby corrected as shown below: Please substitute claim 2 appearing in Column 8 of the patent with the following claim 2:

Claim 2

A stand according to claim 1 wherein for said two vertical rolls the improvement further comprises:

pressure sensor means associated with each said vertical roll for producing a signal representative of the working pressure of each said vertical roll and wherein said control means further includes means for producing a signal representing the modulus of the cassette associated with said vertical rolls, means for receiving said pressure sensor signal and combining it with said modulus signal to produce a position reference signal for the vertical rolls, means for receiving said position reference signal and for applying it with a desired web/flange thickness ratio signal to produce an alternate command signal for operating said servo-valve means, means for alternatively causing a first operation of said

UNITED STATES PATENT AND TRADEMARK OFFICE

CERTIFICATE OF CORRECTION

PATENT NO. : 4,127,997
DATED : December 5, 1978
INVENTOR(S) : André Quehen

It is certified that error appears in the above-identified patent and that said Letters Patent are hereby corrected as shown below:

servo-valve means to maintain a constant web thickness and symmetrical web position relative to a flange portion of the beam or a second operation of said servo-valve means to maintain constant thickness ratio between the web and the flange and a symmetrical web position relative to a flange portion of the beam and for selecting the appropriate position reference signal, said control including means effective only during said second operation of said servo-valve means for rendering inoperative said position reference signal for each horizontal roll.

Signed and Sealed this

***Third* Day of *July 1979***

[SEAL]

*Attest:*

*Attesting Officer*

LUTRELLE F. PARKER
*Acting Commissioner of Patents and Trademarks*